US009468788B2

(12) United States Patent
Bissu

(10) Patent No.: US 9,468,788 B2
(45) Date of Patent: Oct. 18, 2016

(54) RESISTING SYSTEM FOR MAKING VARIABLE MECHANICAL RESISTANCE EXERCISES

(71) Applicant: Moises Bucay Bissu, Col. Granjas Mexico (MX)

(72) Inventor: Moises Bucay Bissu, Col. Granjas Mexico (MX)

( * ) Notice: Subject to any disclaimer, the term of this patent is extended or adjusted under 35 U.S.C. 154(b) by 34 days.

(21) Appl. No.: 14/511,813

(22) Filed: Oct. 10, 2014

(65) Prior Publication Data

US 2015/0105223 A1 Apr. 16, 2015

(51) Int. Cl.

| | |
|---|---|
| ***A63B 21/062*** | (2006.01) |
| ***A63B 21/00*** | (2006.01) |
| ***A63B 23/035*** | (2006.01) |
| ***A63B 23/12*** | (2006.01) |
| ***A63B 24/00*** | (2006.01) |
| *A63B 21/008* | (2006.01) |
| *A63B 21/02* | (2006.01) |
| *A63B 21/06* | (2006.01) |
| *A63B 23/02* | (2006.01) |
| *A63B 71/06* | (2006.01) |

(52) U.S. Cl.

CPC ... *A63B 21/00072* (2013.01); *A63B 21/00076* (2013.01); *A63B 21/0087* (2013.01); *A63B 21/155* (2013.01); *A63B 21/159* (2013.01); *A63B 23/03525* (2013.01); *A63B 23/1209* (2013.01); *A63B 24/0087* (2013.01); *A63B 21/0083* (2013.01); *A63B 21/023* (2013.01); *A63B 21/06* (2013.01); *A63B 21/4035* (2015.10); *A63B 23/0211* (2013.01); *A63B 23/1218* (2013.01); *A63B 23/1227* (2013.01); *A63B 2024/0093* (2013.01); *A63B 2071/068* (2013.01); *A63B 2071/0675* (2013.01); *A63B 2071/0677* (2013.01); *A63B 2071/0683* (2013.01); *A63B 2220/13* (2013.01); *A63B 2220/16* (2013.01); *A63B 2220/803* (2013.01); *A63B 2220/805* (2013.01); *A63B 2225/50* (2013.01); *A63B 2230/105* (2013.01)

(58) Field of Classification Search

CPC ..... A63B 21/00072; A63B 21/00076; A63B 21/0087; A63B 21/0083; A63B 21/159; A63B 21/155; A63B 21/06; A63B 21/4035; A63B 21/023; A63B 24/0087; A63B 23/03525; A63B 23/1209; A63B 23/1227; A63B 23/105; A63B 23/1218; A63B 23/0211; A63B 2220/805; A63B 2220/13; A63B 2220/803; A63B 2220/16; A63B 2071/0683; A63B 2071/0677; A63B 2071/0675; A63B 2230/105; A63B 2230/0093; A63B 2230/50; A63B 21/0058; A63B 21/0069; A63B 21/0072; A63B 21/154; A63B 21/156

See application file for complete search history.

(56) References Cited

U.S. PATENT DOCUMENTS

| | | | | |
|---|---|---|---|---|
| 7,402,128 | B2 * | 7/2008 | Thonn, Jr. ..... | A63B 21/00072 482/137 |
| 7,413,534 | B2 | 8/2008 | Bucay-Bissu et al. | |
| 7,572,213 | B2 | 8/2009 | Bucay-Bissu et al. | |
| 7,758,479 | B2 * | 7/2010 | Husted ..... | A63B 21/00072 482/100 |
| 9,144,702 | B2 * | 9/2015 | Calderone ..... | A61B 5/103 |

* cited by examiner

*Primary Examiner* — Loan H Thanh
*Assistant Examiner* — Megan Anderson
(74) *Attorney, Agent, or Firm* — Nikolai & Mersereau, P.A.; Thomas J. Nikolai

(57) ABSTRACT

The present invention relates to equipment, apparatus and systems used for exercising muscle groups of the body, more specifically, a resistance system for making variable mechanical resistance exercises, which receive voice commands, changes in brain waves and/or any body movement.

13 Claims, 6 Drawing Sheets

RESISTING SYSTEM FOR MAKING VARIABLE MECHANICAL RESISTANCE EXERCISES

FIELD OF THE INVENTION

The present invention relates to apparatuses and systems used for exercising the body. In particular, the invention relates to a variable (weight) mechanical resistance system with pneumatic, mechanical and/or pulley elements for applying to exercising machines. Furthermore, the invention refers to a system for exercise, which allows modulating the mechanical resistance thereof by means of voice commands, brain waves and/or body movements.

BACKGROUND OF THE INVENTION

Over time, resistance machines for use during exercise have been developed in which the weight can be dynamically modified, i.e., during the execution thereof.

One of the goals is being able to optimize each repetition by giving the user more weight at the negative part of the repetition, than at the positive part thereof.

Naturally, everybody has more strength in the negative part than in the positive part.

For example, in the case of a sit-up exercise, the negative part is when we go from a sitting position to a prone position (resisting the weight) and the positive part is when we go from the prone position to the sitting position. In other words, it is when we are lifting the weight or overcoming resistance. The problem with any conventional machine, which cannot offer the user different weights in each part of the repetition, is that it causes the user to reach up to a point of muscular exhaustion when he or she cannot move the weight at the positive part, even when he or she had the extra strength for continuing at the negative part.

The present invention proposes solving this problem by changing the resistance very quickly during each repetition. For example, in a sit-up with weight, the user can select two weights, a first weight when going down (negative part) and a second other very different weight when going up (positive part). The apparatus of the present invention changes between the first, which can be made in fractions of a second. The user can also choose exactly the point in which he or she wishes to make the weight change (resistance), creating with this the infinity of variants in the exercise routine.

A wide variety of equipments are known in the related technical field. However, the majority of the exercise apparatuses do not allow the user to perform exercises with variable resistance with precise and immediate changes in the resistance during the execution of the exercise. Furthermore, there are no exercise apparatuses known which allow the user to use a variety of commands using brain and/or brain waves, or with respect to any body movement detected by the electronic devices, for changing the resistance found during an exercise. Currently, in the state-of-the-art exercise apparatuses, the user has to stop the execution of an exercise, to vary the resistance produced by the apparatus. The applicant only knows variable resistance systems that use voice commands in U.S. Pat. Nos. 7,572,213 and 7,413,534. These two patents are property of the present applicant.

U.S. Pat. Nos. 7,572,213 B2 and 7,413,534 use a pneumatic resistance system, which comprises a piston and a fluid storage tank (air), to generate a variable mechanical resistance during the course of exercise. However, the main problem with the system of U.S. Pat. Nos. 7,572,213 and 7,413,534 and with any other type of pneumatic or hydraulic machines, is that every time the user requires more mechanical (weight) resistance for executing exercise, the piston employed needs to take air from the pressurized air storage tank, or when the user requires a weight reduction, the system has to release air to the environments which creates an enormous waste of air. This implies various disadvantages, which are, among others, the following. The compressor has to work constantly. As a result, there is a need for a compressor of great volumes and a storage tank also with great capacity. Anyway, even when having such a compressor, the user would always have to wait a few seconds to allow the system to become completely charged, to the point where it is able to begin exercise and for changing the weight (resistance) either lighter or heavier.

Furthermore, in case of emergency, there is an air waste in the pervious systems, which results in energy waste, which is used for powering the compressor used to load air to the system.

This problem is solved in the new system of the present invention, as, in one embodiment, the piston is always charged with a fixed pressure pre-established by only being automatically air recharged, if it would loose some pressure. Therefore the invention of the present application generates the mechanical resistance (weight) to the user, by means of a piston connected to a carriage running along a cam arm forming a "simple lever", as the distance of the piston with respect to a determined point is varied.

Another drawback of the inventions described in previous patents, U.S. Pat. Nos. 7,572,213 and 7,413,534, is that in case of emergency, when performing the emergency command in any of the embodiments, such as when the body remains still in a certain position for a fraction of time, the air takes some seconds to exit. This is very undesirable. In the new system of the present application, the mechanical resistance changes, from a maximum resistance to a minimum resistance. This happens in a range of only a fraction of a second.

Unlike the previous patents' systems, U.S. Pat. Nos. 7,572,213 and 7,413,534, with the present invention, the user can choose in which section of the negative part or positive part (at the middle, at the end or at a determined percentage) he or she wants to start having the weight change and in how much time he or she wants such weight, change to be made. The possibilities are infinite regarding the exercise combinations of routines of the user.

Another advantage of the present invention over the U.S. Pat. Nos. 7,572,213 and 7,413,534 is the piston rearrangement. In such patents, the piston is located in the carriage which connects at the same time with the arms of the system. This vertically limits the positioning of such arms and of their rotation, point, as the lower vertical limit for displacing the arms is the stop that exists between the piston rod and the base or the system floor. With the relocation of the piston, a lower limit, which is much lower than the piston rod stop and the system base do not exist. This fact allows an increase in the amount of exercises that a user can perform, because the relation between the rotation point of the arms and the body of the user allows the user to execute the exercise appropriately.

Furthermore, and, in contrast with the previous patent systems, U.S. Pat. Nos. 7,572,213 and 7,413,534, the present invention makes it easier, in mechanical terms, for an improved precision and accuracy in the mechanical resistance (weight) that a user experiences. Because of the mechanical disposition of the elements thereof where, a linear relation between the variation of the weight that the user experiences and the number of strains contained in a guide screw, improved performance results will be explained in greater detail in the description that follows.

Likewise, and, in contrast with the previous patent systems, U.S. Pat. Nos. 7,572,213 and 7,413,534, the present invention, by providing the previous linear relation described between the weight variation experienced by the user and the number of strains contained in the guide screw, it makes it easier to obtain the engineering calculation for optimizing the system. As in U.S. Pat. Nos. 7,572,213 and 7,413,534, the algorithm used for calculating the weight variation experienced by the user is very complex due to the mechanical and thermodynamic factors found in such systems. Therefore the present invention solves the previous problem by providing a mechanical disposition in which the mechanical resistance (weight) experienced by the user is linear in relation to one mechanical factor.

On the other hand, in prior art systems, there is the spatial limit for increasing the maximum weight of an exercise apparatus for increasing the number of weight plates and discs. For example, if the apparatus consists of a total of 20 plates of 10 kg each, the maximum weight for exercising would be of 200 kg. If the user wished to exercise with a weight of 300 kg, this would require the equipment to be disassembled for changing the plates to 15 or 20 kg each, which would be very complicated. The previous technical problem is solved with the present invention, only by increasing the volume or the piston load.

Furthermore, there are also presently individual machines of integrated weight (with plates), for example the "X-force" machine, which suffers from the technical problem of waiting a specific time for the weight change to be made. Another disadvantage is that the weight limit, either lower or higher, is that contained in the machine from the manufacture, i.e., the plates set.

Furthermore, there are individual machines with fluid-base weights or solid-base weights, for example, the brand "srdfitness". These machines do not make an immediate weight change as the fluids take time to pass from one side to the other and, their solid weight versions (which are still in development), are limited in that the maximum weight for the user is the weight already in the machine. In the present invention there is no such limit as the maximum weight can be substantially increased by increasing the volume or load of the piston.

SUMMARY OF THE INVENTION

The present invention relates to a system for making or executing variable mechanical resistance exercises.

More particularly, the present invention refers to a system and apparatus for performing exercise, which comprises a mechanical resistance system, which in one embodiment includes a piston and a storage system known as a "lung".

Still in another aspect, the invention refers to a system of exercise of the described type, in which the mechanical resistance experienced by the user is generated by means of different apparatuses, which allow changing or varying the weight or mechanical resistance experienced by the user when performing an exercise.

Still in another aspect, the invention refers to a system of the described, type, in which the user moves an arm or a lever, connecting, at the same time, an irregular pulley, which is connected to a cam arm by means of a driving element for driving or moving a pneumatic piston or other resistance mechanical element. In other words, when the cam arm is moved, the pneumatic piston or the resistance mechanical element is actuated.

In another embodiment, the invention refers to a mechanical resistance system (weight), where a system arm and a pulley are united and both rotate around a common axis, such that both are simultaneously moved.

In another embodiment, the invention refers to an exercise system, where a regular or irregular pulley can be rotated 180° such that the mechanical resistance generated by the pneumatic system is inverted.

Still in another further embodiment, the invention refers to a mechanical resistance exercise apparatus, which allows the user to change or vary the exercise mechanical resistance (weight), in a fraction of a second.

In a further embodiment, the user moves the arm of the machine when performing push-up exercises such as sit-ups or pull-up movements, such as the so-called deadweight exercise.

In another embodiment, the user moves the arm of the machine to perform push-down exercises for working the triceps or pull-down exercises for strengthening the back.

In a preferred embodiment, the present invention includes an irregular pulley, which can be rotated 180° allowing the user to make push-up or push-down exercises or pull-up or push-up exercises.

In another embodiment, the invention refers to an exercise apparatus wherein the resistance (weight) can be totally different or variable during an exercise in the positive part of a repetition and in the negative part of a repetition. In other words, there is no symmetry in the resistance (weight) experienced by the user in the positive parts or negative parts of the exercise. Therefore, there is a resistance variation (weight) depending on what the user wants in his/her repetitions.

In a further embodiment, the invention involves an exercise apparatus, which allows the user to change or vary the exercise mechanical resistance (weight), during the performance by controlling the apparatus computer by means of voice commands, brain waves and/or specific movements of the body.

Still, in another embodiment, the invention refers to an exercise apparatus, in which the resistance found by a user during an exercise can be adjusted or selected, by means of the introduction of data, via voice commands, brain waves or body movements, for allowing the apparatus applying the resistance for a pre-programmed exercise routine and adjusting the resistance found by the user during a period of time.

In another embodiment, the invention refers to an exercise apparatus, in which the user can program the computer for receiving voice commands, brain waves commands and/or body movement commands, which make the apparatus change the mechanical resistance produced for the exercise, by going to another step in a preprogrammed routine of exercises, or by activating the apparatus in an on or off modality.

In a further embodiment, the invention refers to an exercise apparatus in which user voice commands are received, processed by a microphone or another audio sensor, with which the user can operate the apparatus without the necessity of using the hands.

In a further feature of the invention, the exercise apparatus receives the commands by means of a wireless headset of various channels capable of reading the brain waves and their changes, transforming them into data and subsequently into commands, by which the user can operate the apparatus without the necessity of using the hands and even without the necessity of emitting verbal commands, thus preventing a possible ambient noise interference.

In another embodiment, the invention refers to an exercise apparatus, in which user movement commands are received, by means of motion sensors detecting specific movements of any part of the user body and transform such movements into data, and subsequently into commands, such that the user can operate the apparatus by means of pre-programmed movements.

In another embodiment, the invention refers to an exercise apparatus, which consists of a remote control or a wireless button for controlling the apparatus computer.

In another aspect of the invention, a speaker generating audible welcomes, good-byes, warnings, instructions, background music, and/or any other pre-programmed information for the user.

Still in a further function, the invention refers to an exercise apparatus, which is capable of producing different resistances during the positive part of an exercise repetition.

Still in another embodiment, the invention refers to an exercise apparatus, of the described type, in which a constant resistance can be maintained during an exercise, or which can vary the resistance found by a user during an exercise.

In another aspect, the invention refers to an exercise apparatus of the described type, which retains in the inner memory of the apparatus computer, the specific exercise routines, with the resistances wished by the user during an exercise as well as all the other user configurations.

DETAILED DESCRIPTION

Figure 1:
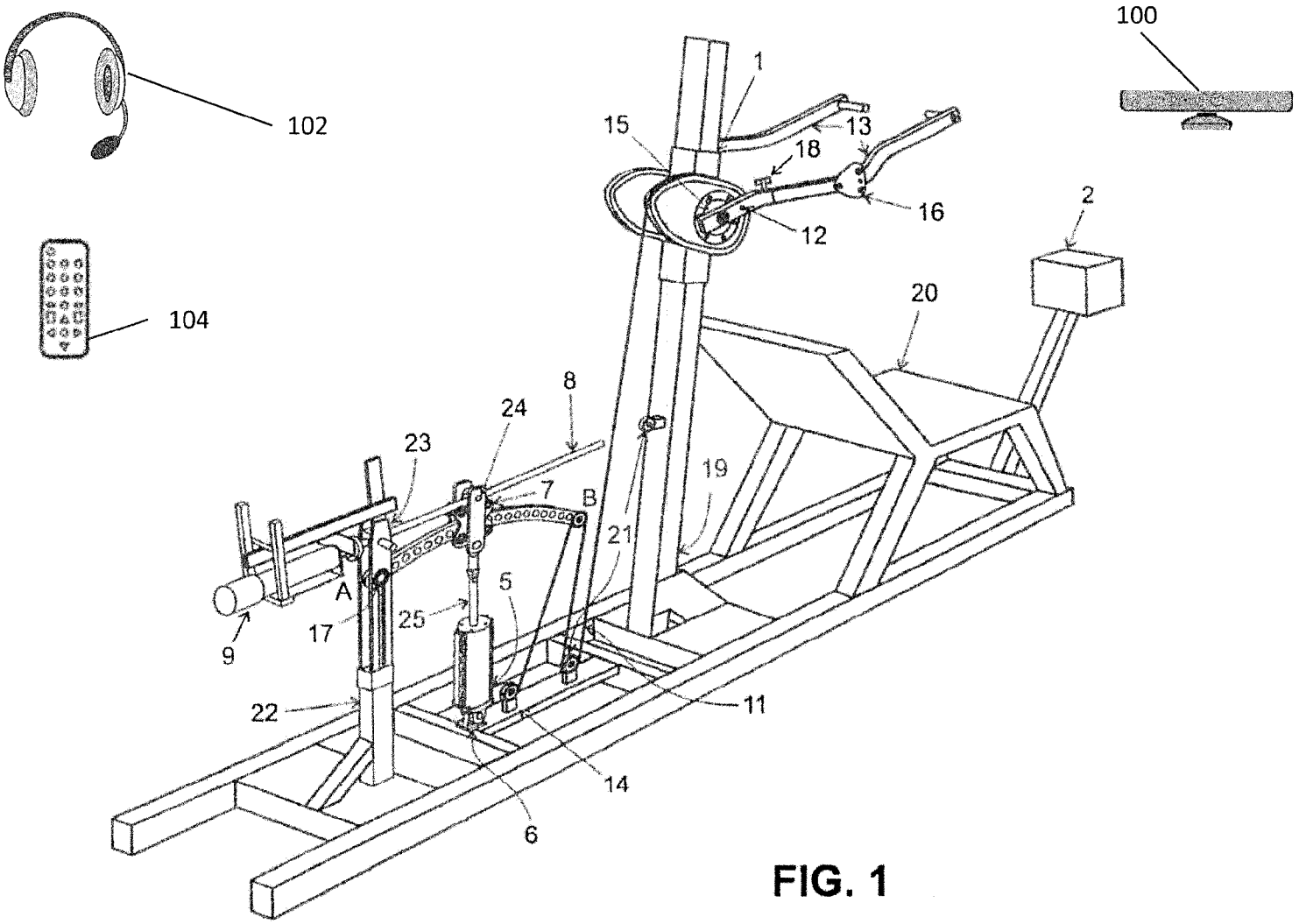
FIG. 1 shows a conventional perspective view of a preferred embodiment of a resistance system for performing variable mechanical resistance exercise.
Figure 2:
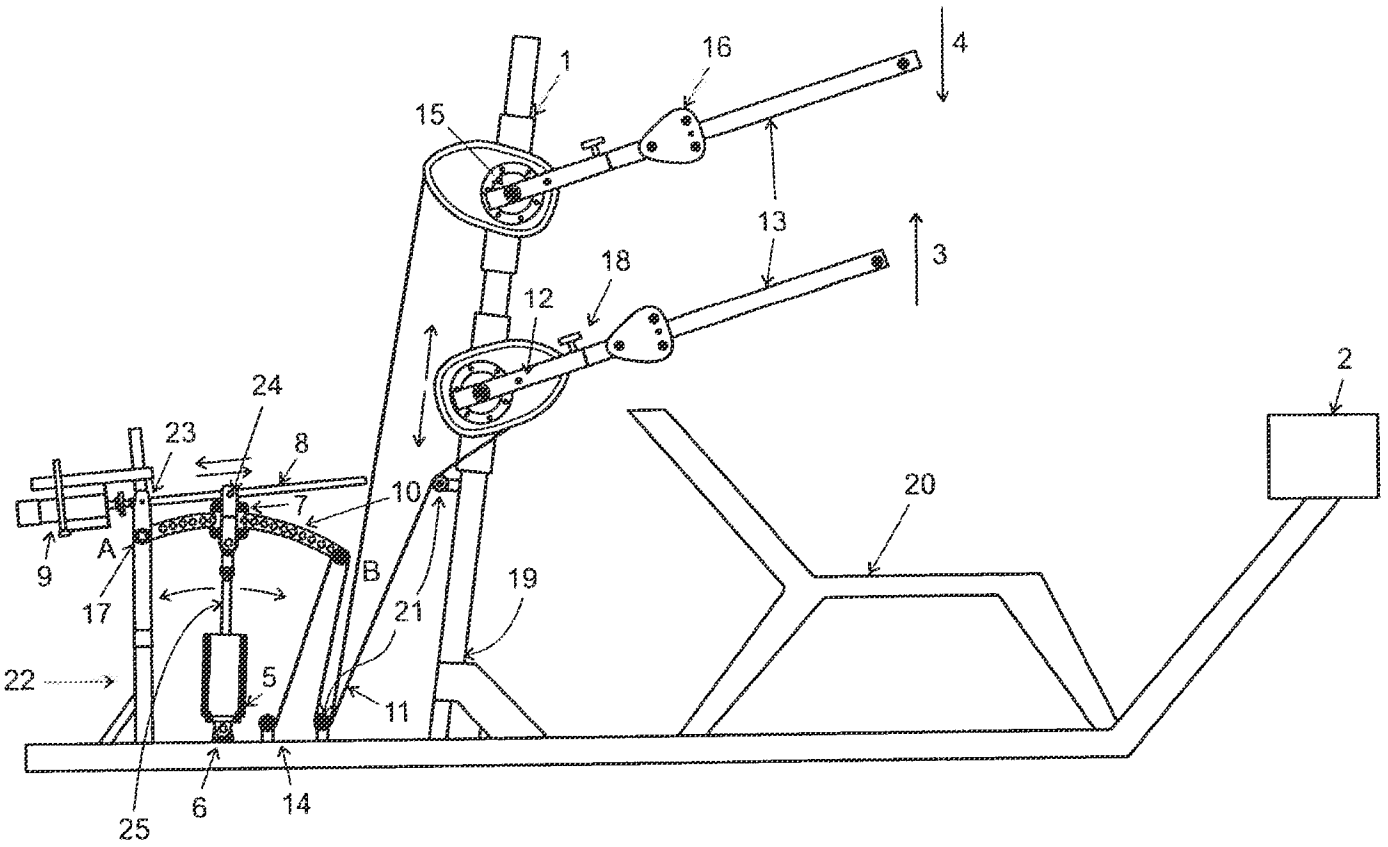
FIG. 2 is a right side view of a resistance system embodiment for performing variable mechanical resistance exercise.
Figure 3:
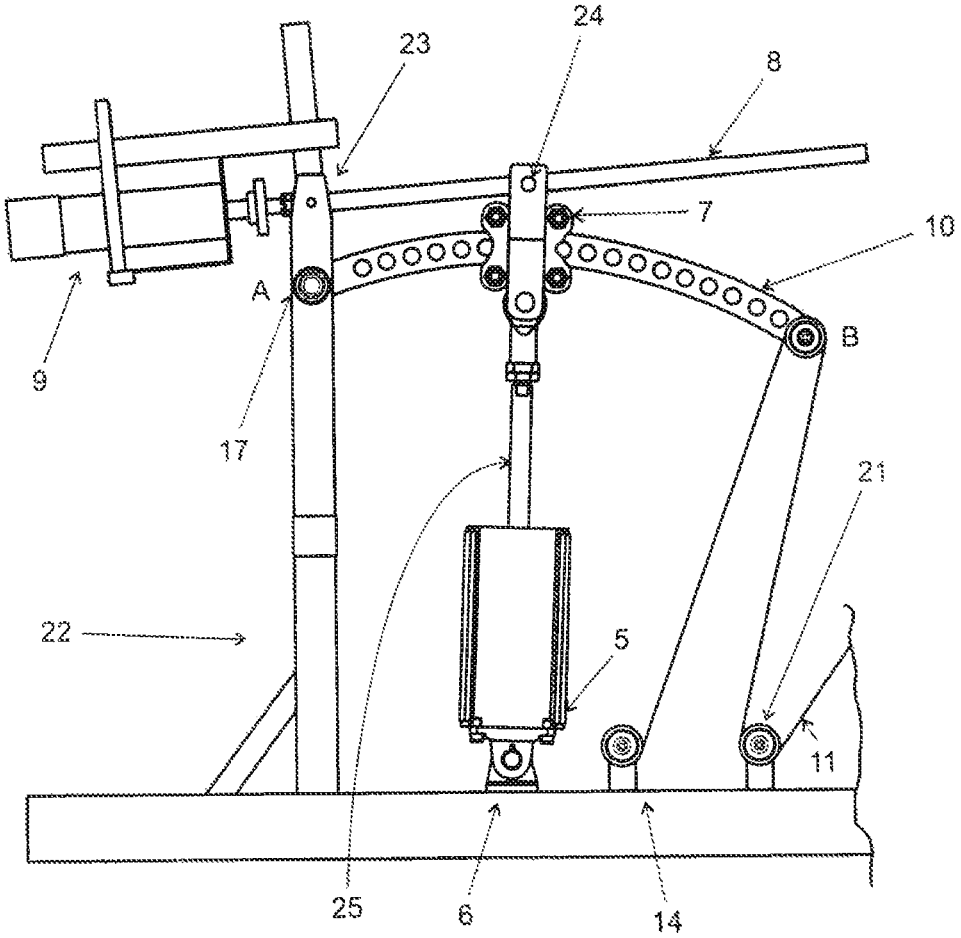
FIG. 3 is a right side view of a resistance system embodiment for making variable mechanical resistance exercise (weight), wherein the piston components (5), cam arm (10), piston rod (25), carriage (7), base (6), support structure (22), motor (9), guiding screw (8), cable (11), pulleys (21) and retractable cartridge (14) are shown.
Figure 4:
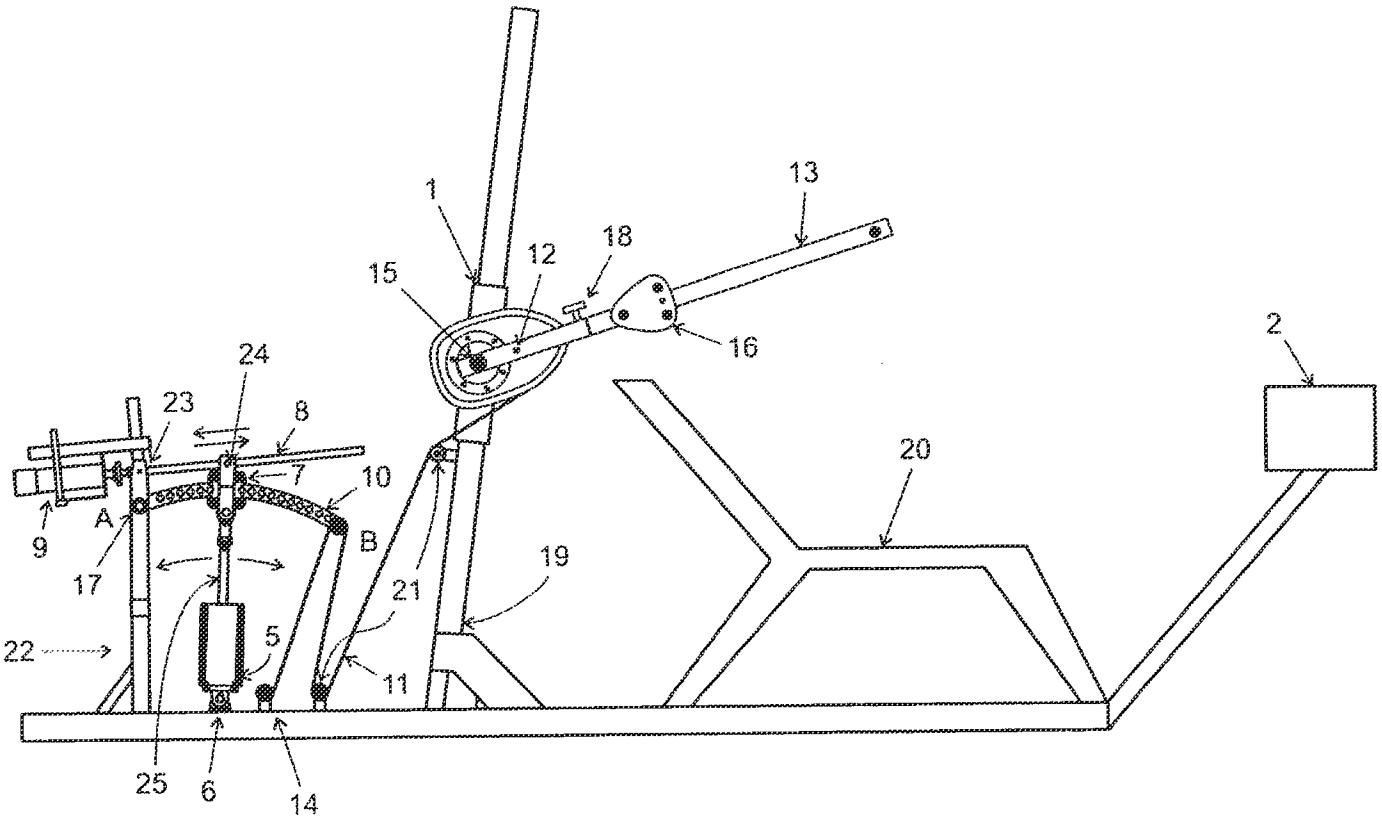
FIG. 4 is a right side view of a resistance system embodiment for making variable mechanical resistance exercise, illustrating the position of the irregular pulley (12) and the carriage (1), for making pull-up or push-up exercises.
Figure 5:
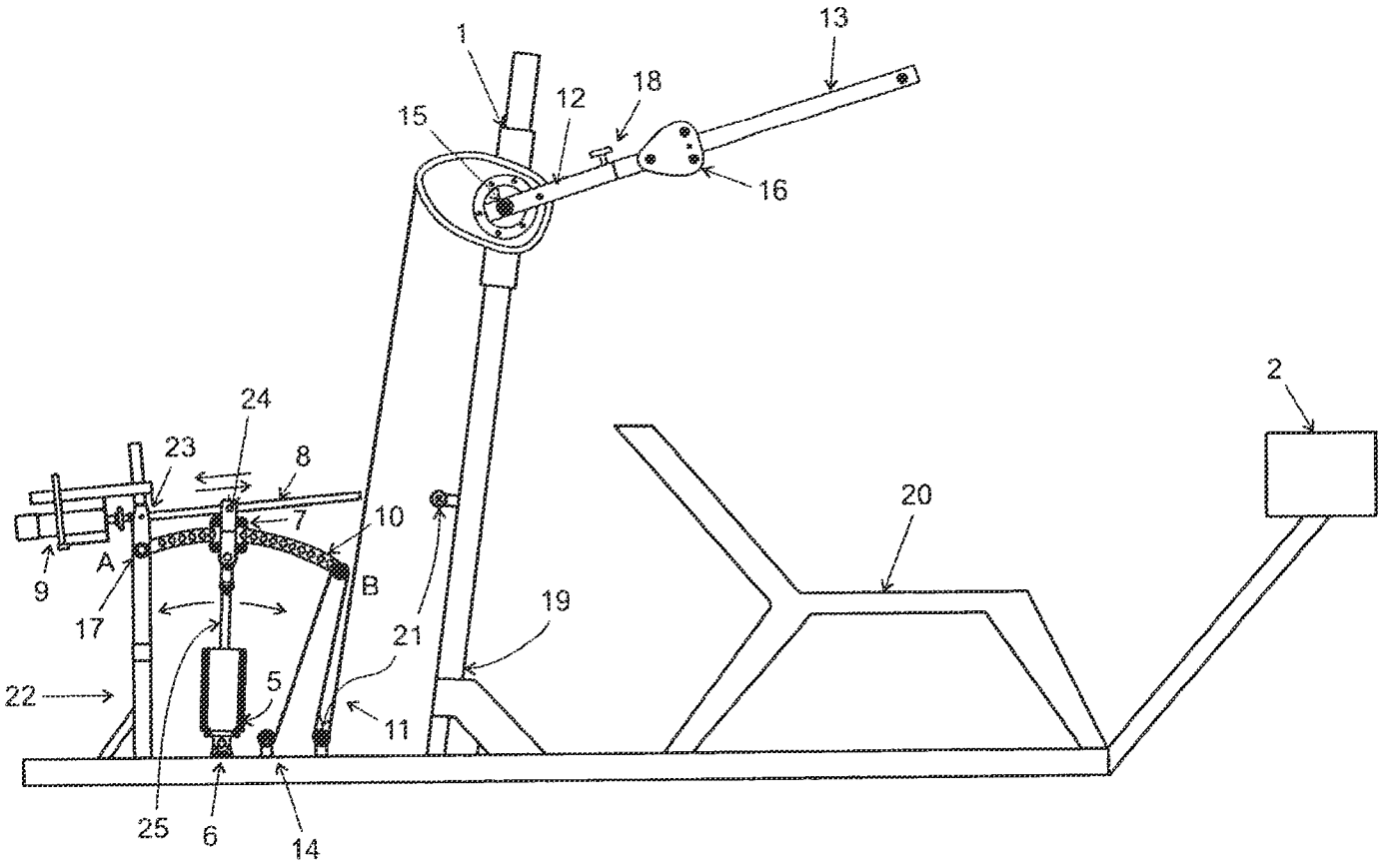
FIG. 5 is a right side view of a resistance system embodiment for making variable mechanical resistance exercise, illustrating the position of an irregular pulley (12) and the carriage (1), for making push-down or pull-down exercises.
Figure 6:
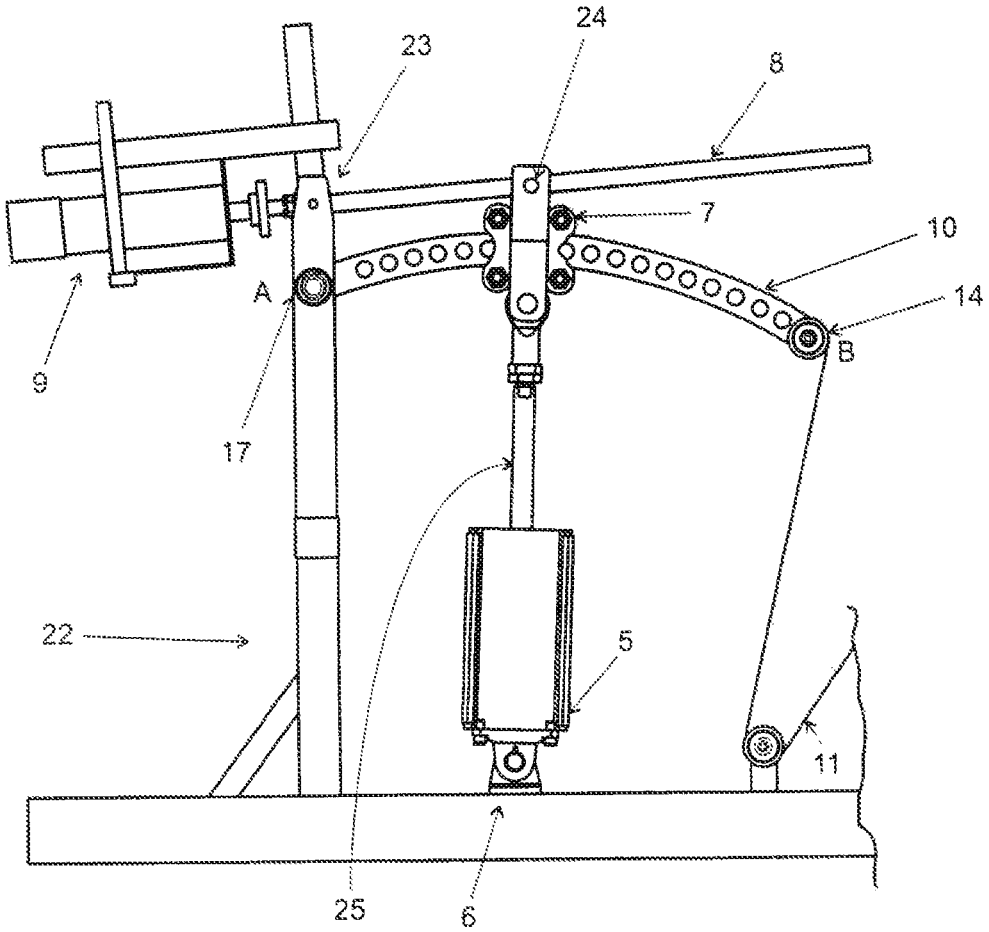
FIG. 6 is a right side view of another embodiment of the variable mechanical resistance exercise (weight), wherein the retractable cartridge (14) is illustrated, positioned at a free end of the cam arm (10).

In a preferred embodiment of the present invention, a mechanical resisting system (weight), consisting of a pneumatic piston, (5) is provided. This piston pivots in its base (6), and the end of its piston rod is connected to a carriage (7) which in turn is connected to a guide screw (8), which is connected to a motor (9), which causes the carriage (7) travel along a cam arm (10) having a pivot point (17). At its free end (B), the cam arm (10) is connected, by a traction element (cable) (11) to the irregular pulley (12), which, in turn, is attached to the arms of the machine (13), and both (arm and pulley) rotate about the axis (15). When moving away the carriage (7) from cam arm pivot (A), "the lever arm" becomes smaller, offering more resistance (weight) to the user and vice versa.

In order to move the carriage (1) which encloses the irregular pulley (12) and arms (13) along the column (19), a system with a retractable cartridge with clutch (14) was designed, it allows feeding an amount of traction element (cable) (11) necessary for the carriage (1) to ascend or descend in the direction of the column (19), so that the common axis (15) of the arms (13) and the irregular pulley (12) fits to the user according to the exercise to be executed.

The facility to vertically move the axis (15) offers the user a range of possible types of exercises that would not be possible if the axis (15) were unable to move vertically. That is, the versatility of this apparatus is the mobility in the vertical axis of the common axis (15) which, depending on the height of the user and the type of exercise to be performed, provide an infinite variety of possibilities to perform exercises, which is impossible in the current prior art exercise machines where if an axis exists, it is not possible to change its elevation, thus, it only serves to exercise a specific muscular group.

For the carriage (1) to move vertically, the cartridge has to be disengaged so that the user sets its position. Once the carriage (1) is fixed in position, the cartridge (14) has to return to its clutch position (get plugged), so that the cam arm (10) is activated. In this way, the mechanical resistance system is activated.

The variations in the mechanical resistance (weight change) for the user are the result of the position of the carriage (7) along the cam arm (10). Therefore, by means of a motor (9) connected to the guide screw (8), which rotates said screw (8), which is connected to a threaded nut on carriage (7), it moves the carriage (7) forward and backward throughout the length of cam arm (10). This generates a "simple lever" and thus provides the user with different mechanical resistance anywhere part of the repetition, according to user requirements.

In the above embodiment, the variation of the mechanical resistance (weight) is linear, where the maximum resistance (weight) that the user experiences is in a spot labeled (B). The "simple lever" provided by the piston system (5) with the cam arm (10) is lower. In the opposite case, the minimum resistance (weight) that the user would experience would be in a spot labeled (A) in FIG. 1. In such a situation, the "simple lever" provided by the piston system (5) with the cam arm (10), is greater. Similarly, the variation of the mechanical resistance (weight) is linear, and directly proportional to the movement of the carriage (7), given by the number of threads crossed by the guide screw (8). Just to mention an example of a preferred embodiment, if the screw comprises 100 threads and the piston pressure is set to provide a variation of mechanical resistance (weight) of 1 kg to 200 kg, in this preferred embodiment, at thread number 50, the user would experience an approximate weight of 100 kg.

The embodiment described above, in mechanical terms facilitates a better or more advanced precision and accuracy in the mechanical resistance (weight) that the user would experience. The mechanical arrangement of its elements provides a linear relationship between the variation of weight experienced by the user and the number of threads on the screw guide (8). Likewise, it facilitates or it is much simpler to obtain engineering calculations to achieve different weights (mechanical resistance) that the user will experience in said embodiment.

Moreover, the present invention consists of at least one arm (13), consisting of a fine adjustment system by steps (16), wherein said arms (13) can vary their configuration and position thanks to the adjusting element (18).

In a preferred embodiment, the irregular (non-circular) pulley (12), connected to a traction element (e.g. a wire) (11), which in turn passes through pulleys (21) and the other end of the cable (11), is connected to a retractable cartridge (14).

The irregular pulley (12), due to the difference in the distance of its axes, makes a "lever" effect, which helps the user to minimize the "spring" effect sensed by the user compressing the piston (5).

The retractable cartridge (14) is connected to one end of the cam arm (10) at (B). The opposite end of the cam arm (10) at (A) is connected to a support structure (22), wherein the axis section (17) allows the cam arm (10) to pivot around the axis (17).

The support structure (22) is disposed vertically, and serves as a support for the cam arm (10).

In a further embodiment, the screw (8) rotates by the motor (9). Seen at the end of the structure (22) is a motor (9) along the axis (23). In addition, the motor (9) is positioned on the structure (22) and the axis (23), wherein the motor (9) moves a guide screw (8), which, in turn, is attached to the carriage (7) by a threaded travelling nut (not shown).

In a preferred embodiment, the motor assembly (9) and the guide screw (8) rest on an axis (23).

In a further embodiment, the guide screw (8) is attached to the carriage (7) throughout the structure containing the axis (24).

In one embodiment, the pneumatic piston (5), pivots on its base (6) and the end of its piston rod is attached to the carriage (7), which is moved by the guide screw (8) and the motor (9) throughout the length of the cam arm (10) having a turn or rotation point. Since moving the carriage (7) backward toward the axis of rotation (17), the "lever" becomes smaller, offering more resistance (weight) to the user and vice versa.

In a further embodiment, a mechanical element able to generate the mechanical strength (weight), which supports the user when performing an exercise, would be necessary. In this embodiment springs, pneumatic devices or devices with thermodynamic or hydraulic features or constant inertial mass elements (plates, discs, etc.) could be considered.

In the embodiment described above, it can also be considered that the combination of the elements described for generating the mechanical resistance (weight) supports the user performing an exercise. That is, in this embodiment a combination of springs and/or pneumatic devices, and/or devices with thermodynamic or hydraulic features and/or constant inertial mass elements (plates, discs, etc.), and/or all combinations thereof could be utilized.

The system to make mechanical resistance exercises, in accordance with the present invention may allow the execution of push-up or pull-up exercises (sit-ups or deadlift), push-down or pull-down (dips or back pulldowns).

In a preferred embodiment, there are irregular pulleys (12), which have at least the following mechanical feature. When these irregular pulleys (12) rotated 180°, it is possible to reverse the direction and sense of the vector magnitude of the resistance applied to the user (weight), wherein said vector variation (magnitude, and direction) allows the user to perform both push-up or pull-up (3) exercises and push-down or pull-down (4) exercises.

Furthermore, the present invention consists of a computer (2), which controls the predetermined exercise programs and all variables, and mechanical changes of the system. Additionally, it has sensors and actuators to activate the motor (9), which is attached to and causes a turning movement to the screw (8), which in turn is attached to the carriage (7), which is moved by the screw (8) in order to vary the mechanical resistance (weight) received by the user, by the aforementioned "lever" effect. A remote control (or a wireless button) 104 may be employed to control the computer 2.

In a preferred embodiment, the system has sensors, actuators and/or devices that receive information from the user, which are connected to the computer, either directly (wired) or wirelessly.

In order for the control system to know the path the user will follow during an exercise, it is necessary that the user "indicates" (make a full repetition without weight) a repetition on its both parts (positive and negative). This is measured by a potentiometer (encoder) sensor, etc., which can be connected to either the pulley (21) or the pivot (17) of the cam arm (10) or to the pivot (15) of the arms (13). Also in another embodiment, a linear potentiometer (sensor) can be connected in the piston rod (25), which measures the performance or longitudinal extension thereof.

During the "indicate" stage of the user, this can also be achieved with a body scanning sensor through a sensor as used in video games where the user becomes part of the system sensors 100 and/or controls like "Kinect (Xbox)", which will register all movements of the user's body in the initial position and in the "indicate" stage of the repetition (positive and negative).

Once the computer system records data movement (exercise) completely, it will output a signal to indicate the user know it is ready to receive the start order or command of the exercise.

Said command can be given in several ways:

In a further embodiment, it can be recorded by voice through a microphone installed anywhere in the system or through a wired or wireless headset 102 with microphone, which sends the signal and/or information to the computer.

In another embodiment, it can be recorded by a specific motion (pre-programmed by each user) of any part of the body, e.g., duck down twice; this shall be recorded by the motion sensor like "Kinect" and will be interpreted by the computer system as a command to adjust the initial resistance (initial weight).

In another embodiment, through a multi-channel wireless headset ("Emotivinsight"), which measures brain waves and its changes, as well as some gestures (winks, smiles, etc.) or any facial gestures and/or head movements, it sends this information to the computer system which transforms it into commands.

For any dynamic variation resistance (weight), according to what has been pre-programmed by the user, this can also be achieved by giving the same commands with the above elements. Where these commands are used to start, stop and/or vary the resistance (weight) received by the user.

In one embodiment and in the case of an emergency or when the user has finished the exercise and wants the system to reduce weight to a minimum, he or she can use any of the above procedures.

In another additional embodiment, the retractable cartridge with clutch (14) is positioned at a free end of the cam arm (10).

The invention has been described sufficiently, so that a person with ordinary skills in the art can reproduce and obtain the results mentioned herein. However, any person with average knowledge in the art of the present invention can make modifications not described in this application, nevertheless, within the scope of protection of the invention, either for the application of such modifications in a determined structure or in the manufacturing process thereof, the material claimed in the following claims is required, said structures will be comprised within the scope of the invention.

The invention claimed is:

1. An exercise machine comprising:

a base member;

a first column extending upwards from the base member;

a first carriage slidably mounted on said first column and movable therealong between at least two operating position;

an irregular pulley pivotally affixed to the first carriage for rotation through 180° about a pivot axis;

at least one arm affixed to the first carriage and projecting outward therefrom;

at least one traction element connected at one end to the irregular pulley;

a retractable cartridge incorporating a clutch affixed to the base member and having another end of the traction element affixed to the retractable cartridge;

a computer mounted to the base member;

a pneumatic piston pivotally connected to the base member and with a piston rod extending upward;

a second column extending upwards from the base member;

a cam arm pivotally connected at one end to the second column and having a pulley at a free end thereof and cooperating with the traction element;

a second carriage slidably mounted on the cam arm and connected to the piston rod, the second carriage including a threaded travelling nut; and a threaded guide screw cooperating with the threaded travelling nut, said guide screw being driven by a motor supported by the second column whereby translation of the second carriage along the cam arm varies the force needed to raise or lower the at least one arm.

2. The exercise machine according to claim 1, characterized in that it allows dynamic variation of the mechanical resistance that a user experiences during exercise by varying the position of the second carriage along the cam arm.

3. The exercise machine according to claim 2, characterized in that it allows dynamic variation of the mechanical resistance experienced by the user during positive and negative phases of an exercise.

4. The exercise machine according to claim 3, characterized in that it allows the user to dynamically vary the mechanical resistance experienced by the user at any position of the positive part of the exercise.

5. The exercise machine according to claim 3, characterized in that it allows the user to dynamically vary the mechanical resistance experienced by the user at any position of the negative part of the exercise.

6. The exercise machine according to claim 1, wherein the computer activates the motor, which, in turn, rotates the guide screw to move the second carriage to vary the mechanical resistance experienced by the user.

7. The exercise machine according to claim 6, comprising means for modulating the mechanical resistance.

8. The exercise machine according to claim 6 further comprising a wireless headset.

9. The exercise machine according to claim 6 further comprising at least one motion sensor.

10. The exercise machine according to claim 1, characterized in that when rotating the irregular pulley 180°, the direction and sense of the vector magnitude of the resistance applied to a user is reversed, wherein said vector variation in magnitude, direction and sense enables the user to perform both push-up or pull-up exercises and push-down or pull-down exercises.

11. The exercise machine according to claim 1, characterized in that the retractable cartridge with clutch allows feeding of the amount of the traction element necessary for the first carriage to move up and down in the direction of the first column such that a common axis of the arms and of the irregular pulley suits the user according to the exercise to be executed.

12. The exercise machine according to claim 1, characterized in that the variation of the mechanical resistance is linear, and directly proportional to the forward movement of the second carriage, determined by the number of threads crossed by the guide screw.

13. The exercise machine according to claim 1 further comprising a wireless remote control.

* * * * *